US006279599B1

(12) United States Patent
Chen

(10) Patent No.: US 6,279,599 B1
(45) Date of Patent: Aug. 28, 2001

(54) AIR HOSE ASSEMBLY FOR A PORTABLE TIRE PUMP AND HAVING THE DUAL FUNCTIONS OF AIR INFLATION AND PRESSURE RELEASE

(76) Inventor: Chih-Ming Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 09/468,794

(22) Filed: Dec. 21, 1999

(51) Int. Cl.[7] ..... F16K 15/20

(52) U.S. Cl. ..... 137/228; 137/231; 152/415; 251/336

(58) Field of Search ..... 137/223, 231, 137/228; 152/415; 251/339

(56) References Cited

U.S. PATENT DOCUMENTS

| | | | | |
|---|---|---|---|---|
| 1,420,997 | * | 6/1922 | Freeman | 73/146.8 X |
| 1,666,283 | * | 4/1928 | Farley | 73/146.8 X |
| 1,818,178 | * | 8/1931 | Weisberg | 137/228 X |
| 2,047,405 | * | 7/1936 | Byars | 137/228 |
| 2,320,042 | * | 5/1943 | McMahan | 152/415 X |
| 3,429,332 | * | 2/1969 | Mazeika | 137/228 |
| 3,860,054 | * | 1/1975 | Prottey | 152/415 |
| 3,866,654 | * | 2/1975 | Duquesne | 157/1.1 |
| 3,995,653 | * | 12/1976 | Mackal et al. | 137/234 |
| 4,807,658 | * | 2/1989 | Patti | 137/223 |
| 5,203,831 | * | 4/1993 | Lind et al. | 137/1 |
| 5,275,197 | * | 1/1994 | Finell | 137/223 X |
| 5,305,784 | * | 4/1994 | Carter | 137/231 |
| 5,398,744 | * | 3/1995 | Street et al. | 152/429 |
| 5,668,314 | * | 9/1997 | Jones | 73/129 |
| 5,746,243 | * | 5/1998 | Franke | 137/231 |
| 5,785,076 | * | 7/1998 | You | 137/231 |
| 5,878,774 | * | 3/1999 | Zanetti | 137/228 |

* cited by examiner

*Primary Examiner*—Michael Powell Buiz
*Assistant Examiner*—Meredith H. Schoenfield
(74) *Attorney, Agent, or Firm*—A & J

(57) ABSTRACT

An air hose assembly for a portable tire pump and having the dual function of air inflation and pressure release, which utilizes the same air hose structure to perform tire inflation and pressure release without the need to remove the air hose during pressure release, so as to eliminate the problem of the user having to press the air nozzle core of the tire with a pointed object or with his finger to release the tire pressure when the tire is over-inflated. Besides, the pressure is released quickly to arrive at a normal pressure level.

3 Claims, 5 Drawing Sheets

AIR HOSE ASSEMBLY FOR A PORTABLE TIRE PUMP AND HAVING THE DUAL FUNCTIONS OF AIR INFLATION AND PRESSURE RELEASE

BACKGROUND OF THE INVENTION (a) Field of the Invention

The present invention relates to an air hose assembly for a portable tire pump and having the dual function of air inflation and pressure release.

(b) Description of the Prior Art

In a conventional medium- or small-sized portable air pump for use in vehicles, the air hose assembly connected therewith works in a single direction, i.e., permitting air inflation only. With reference to FIGS. 1 and 2, an air hose assembly A10 is shown to include an abutting rubber ring A1, a hollow core A2, an air nozzle screw sleeve A3, a tightening ring A4, and an air hose A5.

During inflation, an air nozzle cap on the tire is removed, and the air nozzle screw sleeve A3 is screwably coupled to an outer screw sleeve of the air nozzle of the tire. At this time, insertion of the air nozzle screw sleeve A3 will simultaneously pushed the hollow core A2 to displace fowardly to directly press against an air core in the air nozzle of the tire. By means of the abutting rubber ring A1 at the front end of the assembly to abut against the air core, the latter is caused to open, so that compressed air generated as a result of operation of a piston of the air pump is pumped into the tire via the air hose A5 to inflate the tire.

During the process of inflation, the tire may be over-inflated inadvertently; the conventional air pump is generally provided with a pressure gage to indicate the pressure of the tire. In order to restore the pressure in the tire to a normal level, deflation to reduce tire pressure is required. To reduce the tire pressure, the user has to use a pointed object or his finger to press the air nozzle air core so that the pressure in the tire is released.

However, once the air hose assembly A10 is removed from the tire, it is no longer possible to read the tire pressure. Therefore, it is not known whether a suitable tire pressure has been released. That is, the tire pressure may be below normal or still be above normal. If the pressure released is excessive, the tire will need to be inflated again. It the pressure released is too little, the tire pressure remains high, which will endanger road safety. Furthermore, the conventional method of releasing the fire pressure is very slow and inconvenient, and the use may hurt his fingers or damage the air nozzle of the tire during release of tire pressure.

SUMMARY OF THE INVENTION

A primary object of the present invention is to provide an air hose assembly for a portable tire pump and having the dual function of air inflation and pressure release, in which the same air hose structure is used to perform both air inflation and pressure release without the need to remove the air hose, and pressure can be released quickly to arrive at a normal level.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
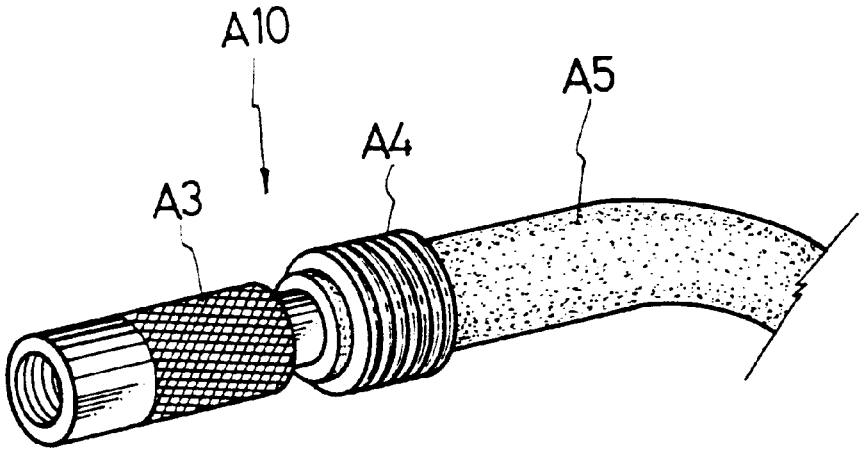
PRIOR ART FIG. 1
FIG. 1 is a perspective view of a conventional air hose assembly.
Figure 2:
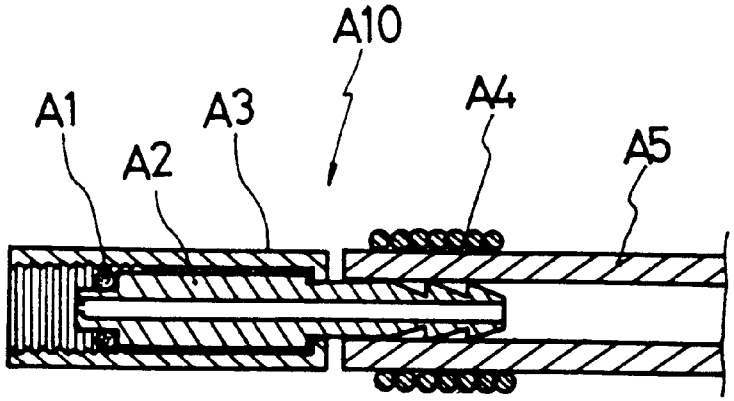
PRIOR ART FIG. 2
FIG. 2 is a sectional view of the conventional air hose assembly.
Figure 3:
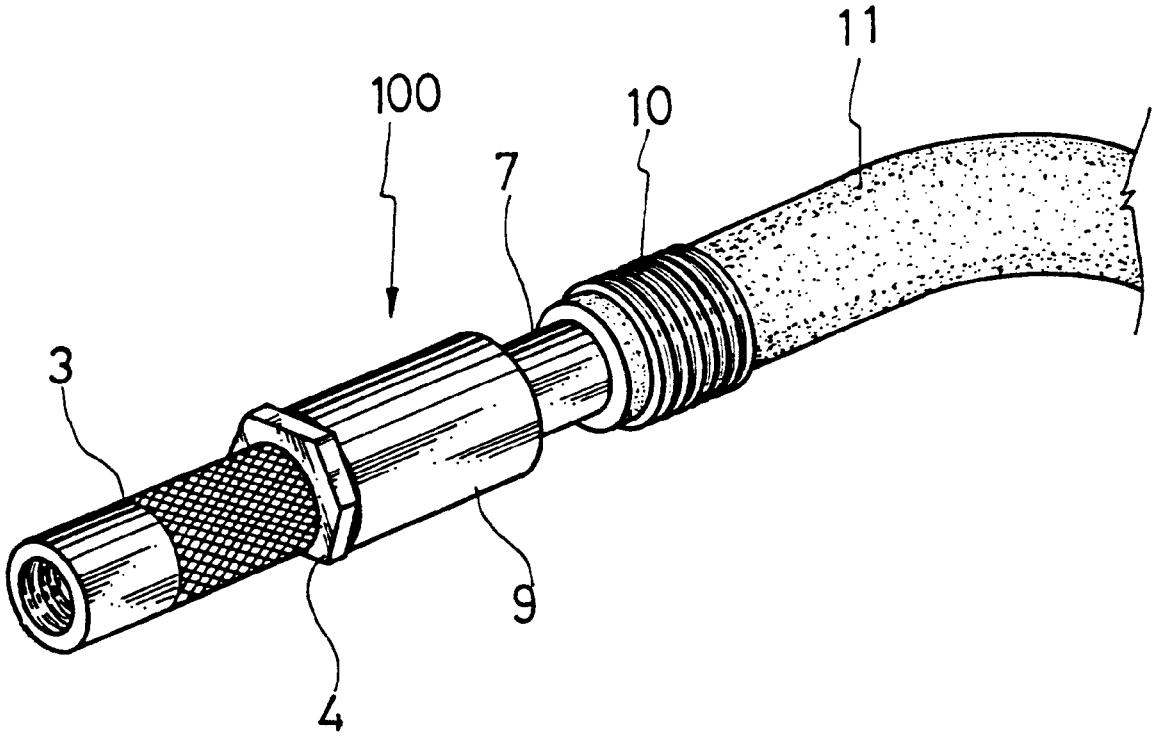
FIG. 3 is a perspective view of an air hose assembly of the present invention.

With reference to FIG. 3, an air hose assembly 100 according to the present invention is used in the same manner as conventional ones. That is, it has an air nozzle screw sleeve 3 that is threadedly coupled to an external screw sleeve (not shown) of the air nozzle of a tire.

Figure 4:
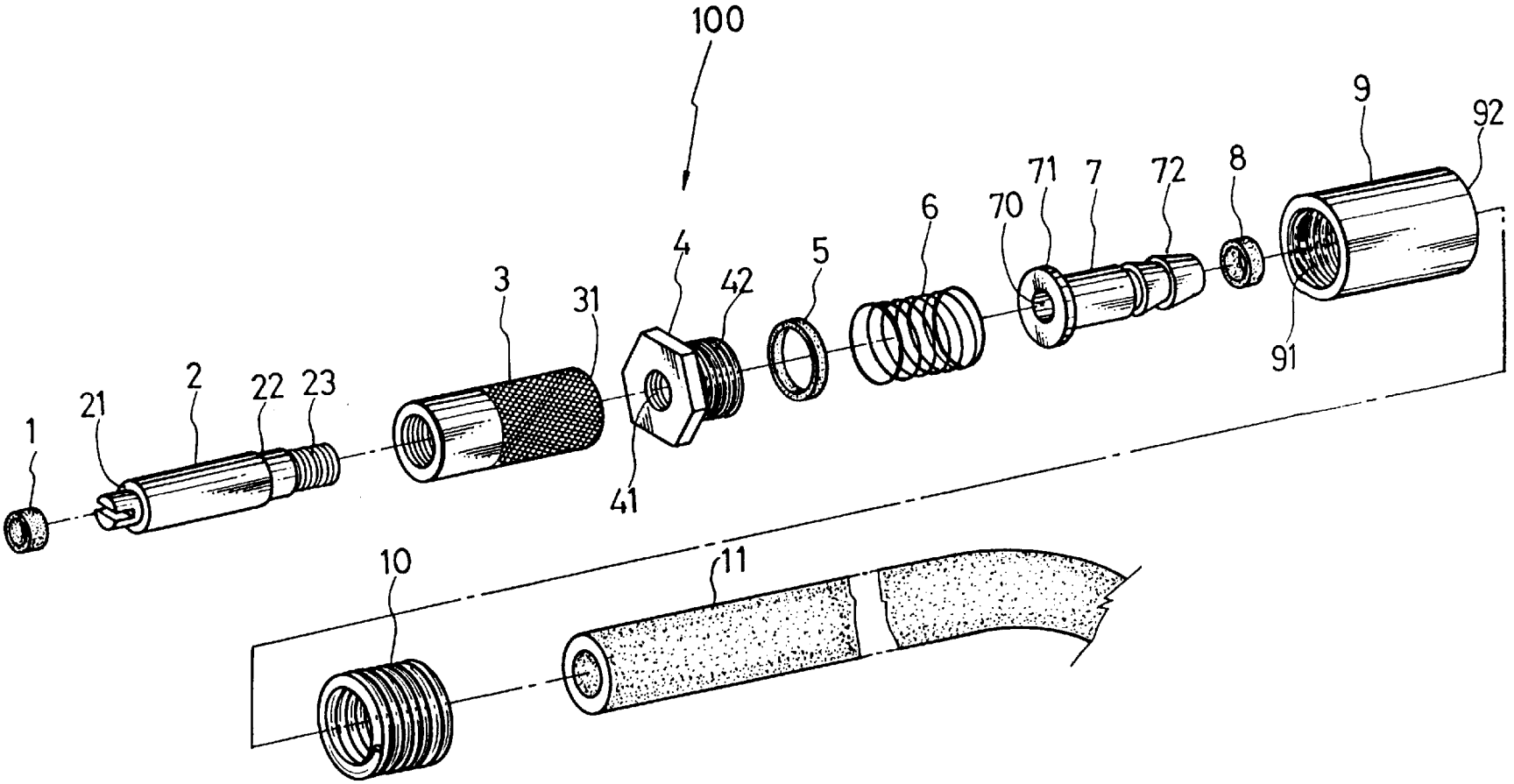
FIG. 4 is an exploded perspective view of the present invention.

With reference to FIG. 4, the air hose assembly 100 according to the present invention includes an abutting rubber ring 1, a hollow core 2, the air nozzle screw sleeve 3, a connecting screw 4, a washer 5, a tension spring 6, an insert valve tube 7, a valve tube rubber ring 8, a rear screw sleeve 9, a tightening ring 10, and an air hose 11. The abutting rubber ring 1 is fitted on an edge portion 21 of a front end of the hollow core 2. When the air nozzle screw sleeve 3 is threadedly coupled to the external screw sleeve of the air nozzle of the tire, the front end of the hollow core 2 therein utilizes the abutting rubber ring 1 to be tightly positioned at an air core of the tire's air nozzle so that the air core is in an open state. A rear end of the hollow core 2 is provided with a lip portion 22 and external threads 23. When the hollow core 2 passes through a rear end hole 31 of the air nozzle screw sleeve 3, it is prevented from slippage due to the abutting action of the lip portion 22, and the external threads 23 achieves a locking function With an internal threaded hole 41 of the connecting screw 4, further achieving a through structure.

Figure 5:
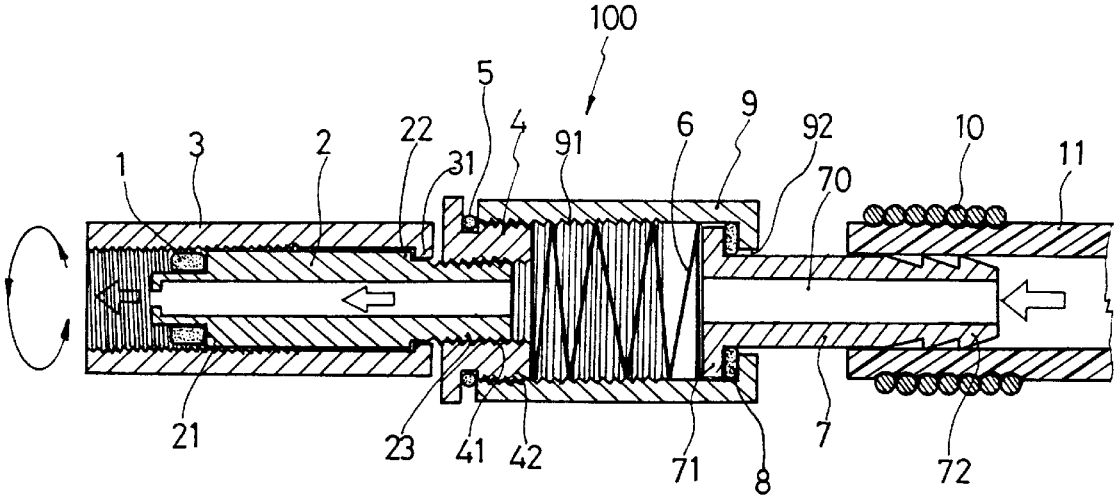
FIG. 5 is a sectional view illustrating operation of the present invention in the process of inflation.

The connecting screw 4, in addition to having the internal threaded hole 41 to be threadedly connected to the hollow core 2, has an external threaded portion 42 for threaded connection with the rear screw sleeve 9, so that it serves as an important connecting element. Furthermore, the washer 5 is sleeved on the external threaded portion 42 of the connecting screw 4, and the insert valve tube 7 and tension spring 6 are disposed in sequence in the rear screw sleeve 9, which are locked therein by the connecting screw 4 to thereby form an integral structure. With reference to FIG. 5, the rear screw sleeve 9 is likewise provided with internal threads 91 for threaded engagement with the connecting screw 4. The washer 5 fitted on the threaded portion 42 of the connecting screw 4 prevents air leakage.

With further reference to FIG. 5, the insert valve tube 7 and the tension spring 6 disposed inside the rear screw sleeve 9, due to the locking of the connecting screw 4, forms a restricting structure. The insert valve tube 7 includes a hollow tubular body 70 with a valve disk 71 at a front end and an insert portion 72 at a rear end thereof. The insert portion 72 is inserted into the rubber air hose 11 (in a position such that it maintains a suitable distance with the rear screw sleeve 9 to allow displacement), and is held in position by the tightening ring 10. In addition, the valve tube rubber ring 8 is fitted inside the valve disk 71. By utilizing the tension spring 6 to abut against the valve disk 71, the valve tube rubber ring 8 can abut against a rear hole 92 of the rear screw sleeve 9 to achieve tight closure.

Figure 6:
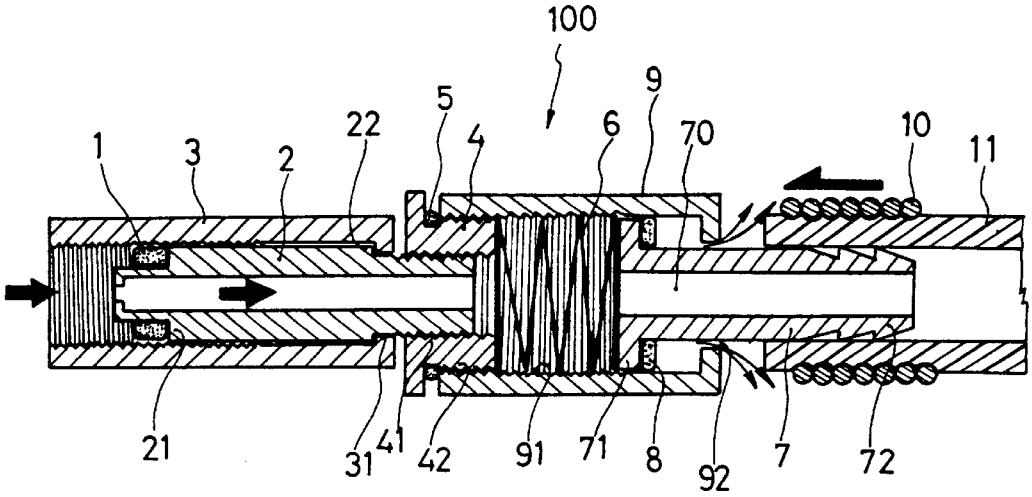
FIG. 6 is a sectional view illustrating operation of the present invention in the process of pressure release.

With reference to FIG. 6 as well as FIG. 5, under normal air inflation conditions, as the rear hole 92 of the rear screw sleeve 9 is acted upon by the tension spring 6, it is in a closed state so that it can be used for tire inflation, as shown in FIG. 5.

When it is necessary to release the tire pressure, the air hose 11 is pushed forwardly so that the insert valve tube 7 displaces forwardly and is in an open state, whereby the tire pressure can be quickly released via the hollow core 2 to the rear screw sleeve 9 to be discharged via the end hole 92.

Figure 7:
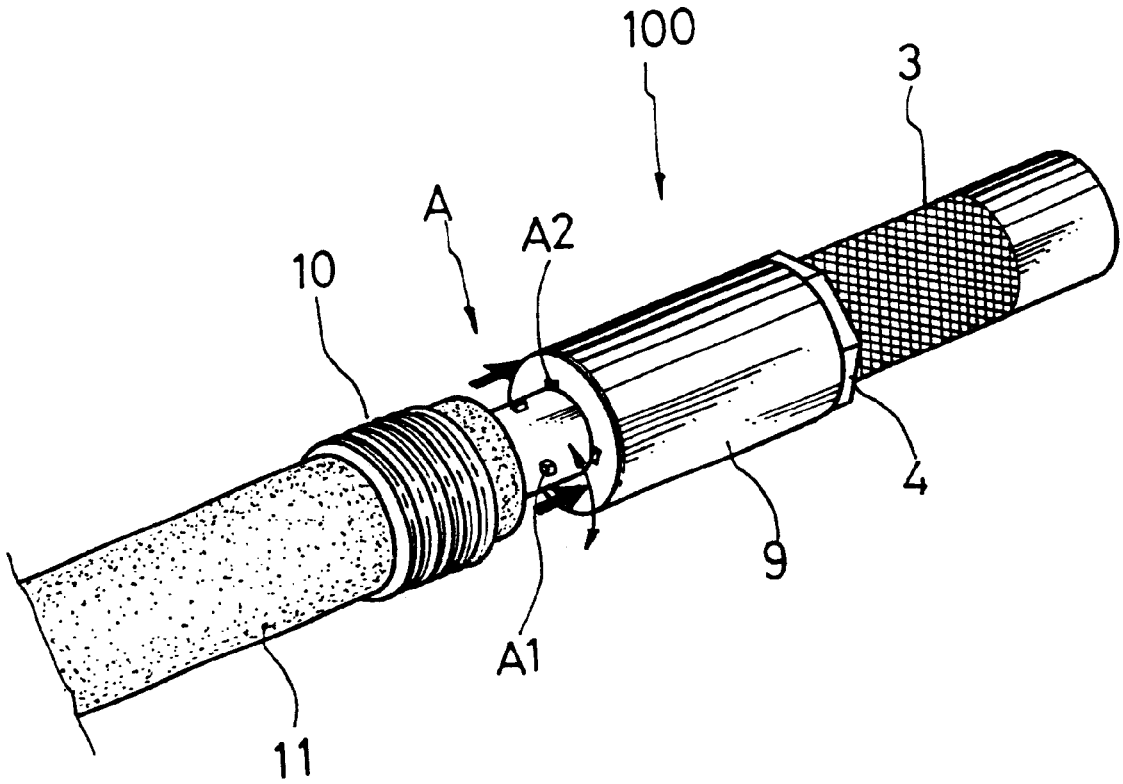
FIG. 7 is a schematic view of another embodiment of the present invention, which further has a pressure release securing device.

With reference to FIG. 7, to enable pressure release for a relatively long period of time, the present invention may further comprise a pressure release securing device A to dispense with the need to exert a force to push the air hose 11 for a long period of time and to thereby achieve automatic pressure release. In this construction, positioning bosses A1 are provided on the outer periphery of the insert valve tube 7 in suitable positions, and the end hole 92 of the rear screw sleeve 9 is provided with corresponding grooves A2 in a bottom edge thereof.

When a force is applied to the air hose 11 to cause it to displace, the insert valve tube 7 therein will retreat inwardly so that the positioning bosses A1 passes through the grooves A2. By exerting a suitable turning force, the insert valve tube 7 can be fixed in a position to allow pressure release. After pressure release, the procedures are proceeded in a reverse direction to thereby complete the pressure release operation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An air hose assembly for a portable tire pump and having the dual functions of inflation and pressure release, in which an air nozzle screw sleeve is threadedly coupled to an external screw sleeve of an air nozzle of a tire so that inflation and pressure release can be achieved in the same air hose structure, said air hose assembly comprising an abutting rubber ring, a hollow core, an air nozzle screw sleeve, a connecting screw, a washer, a tension spring, an insert valve tube, a valve tube rubber ring, a rear screw sleeve, a tightening ring and an air hose, wherein the abutting rubber ring is fitted on an end portion of a front end of the hollow core, the hollow core having a lip portion and external threads at a rear end so that when the hollow core passes through a rear end hole of the air nozzle screw sleeve, the hollow core can be prevented from slippage by the abutting action of the lip portion, the external threads being threaded engaged with an internal threaded hole of the connecting screw to thereby achieve a through structure; the connecting screw being threadedly received in the hollow core by means of the internal threaded hole and further having an external threaded portion for threaded engagement with the rear screw sleeve, the washer being fitted on the external threaded portion of the connecting screw, the insert valve tube and the tension spring being disposed in the rear screw sleeve in sequence and being positioned by means of the connecting screw to thereby achieve an integral structure, the rear screw sleeve being provided with internal threads for threaded engagement with the connecting screw and having an end hole at a rear end thereof for passage of the insert valve tube and discharge of tire pressure; the insert valve tube and the tension spring disposed inside the rear screw sleeve forming a spring-based valve structure, in which the insert valve tube is a hollow tubular body having a valve disk at a front end and an insert portion at a rear end, the valve tube rubber ring being fitted inside the valve disk, the insert portion being inserted into the air hose and being secured in position by the tightening ring.

2. An air hose assembly as defined in claim 1, wherein a suitable distance is maintained between the insert valve tube and the rear screw sleeve after the insert valve tube is inserted into the air hose so as to permit displacement and pressure release.

3. An air hose assembly as defined in claim 1 further comprising a pressure release securing device, in which positioning bosses are provided on an outer periphery of the insert valve tube in suitable positions, the end hole of the rear screw sleeve being provided with corresponding grooves in a bottom edge thereof, whereby when the insert valve tube retreats inwardly during pressure release operation, the positioning bosses pass through the grooves and, by applying a suitable turning force, the insert valve tube can be positioned to achieve pressure release to thereby permit pressure release for a relatively long period of time.

* * * * *